United States Patent [19]

Perry

[11] 4,082,076

[45] Apr. 4, 1978

[54] SPRING TYPE BALL-PITCHING APPARATUS

[76] Inventor: Jack A. Perry, Box 294, McCamey, Tex. 79752

[21] Appl. No.: 688,128

[22] Filed: May 20, 1976

[51] Int. Cl.[2] ..... F41B 3/02

[52] U.S. Cl. ..... 124/7; 124/34; 124/41 R; 273/26 D

[58] Field of Search ..... 124/7, 6, 41 R, 17, 124/34, 35; 273/26 D

[56] References Cited

U.S. PATENT DOCUMENTS

| | | | |
|---|---|---|---|
| 894,738 | 7/1908 | Hindmarsh | 124/7 |
| 943,494 | 12/1909 | Venn | 124/7 |
| 1,344,378 | 6/1920 | Butler | 124/7 |
| 3,777,733 | 12/1973 | Mitchell | 124/7 |

*Primary Examiner*—William R. Browne
*Attorney, Agent, or Firm*—Marcus L. Bates

[57] ABSTRACT

The ball-pitching apparatus of this invention has a ball-holding container affixed to one end of an arm. A baseball can be releasably supported within the container. The arm is pivotally mounted to a base such that opposed ends of the arm may be pivoted with respect to the base.

A pitching spring and an arresting spring are affixed to the base. The remaining end of the pitching spring is connected to the arm at a location between the ball-holding container and the pivot point, while the remaining end of the arresting spring is secured to the end of the arm which is opposite to the baseball-holding container.

The springs normally bias the arm into a position of rest, and when the arm is yieldably forced to pivot in opposition to the pitching spring, energy is stored therewithin. The springs have respective ends that are anchored to a common point on the base. When the arm is released, the pitching spring accelerates the arm with sufficient velocity to accelerate the ball, so that when the arresting spring arrests the pivotal movement of the arm, the baseball leaves the container and continues to travel through the air.

6 Claims, 7 Drawing Figures

SPRING TYPE BALL-PITCHING APPARATUS

BACKGROUND OF THE INVENTION

Apparatus by which a baseball is mechanically thrown or pitched to a batter has been proposed in the prior art as evidenced by the U.S. Pats. to McMillan, No. 1,203,027; Butler, No. 1,344,378; Pilates, No. 1,785,876; Mauney, No. 1,825,882; Richter, No. 2,153,315; and Calabrese, No. 2,318,139.

Some baseball-pitching devices of the prior art are oversimplified and therefore fail to generate the various different forces required so that the resultant components thereof cause the baseball to travel along a trajectory which is reproduceable and which simulates the actual throwing of a baseball by a baseball pitcher.

Other baseball-pitching apparatus of the prior art is extremely complex and expensive, as exemplified by Andersen U.S. Pat. No. 3,128,752; Laney U.S. Pat. No. 3,213,843; and Mitchell U.S. Pat. No. 3,777,733.

A baseball-pitching apparatus which can be manipulated by a batter with no assistance from anyone else would be desirable. Moreover, it is desirable that such a device be simple but dependable in operation and low in cost. It is also desirable that the apparatus have the provision by which the trajectory of the baseball can be reproduceably controlled so that each time the apparatus is actuated, the ball assumes the same relative path of flight as it travels across the batter's plate.

Most prior art baseball-pitching devices are extremely complex and expensive; therefore, the average "little league" baseball player cannot avail himself of this desirable mechanism. It would therefore be desirable to provide a baseball-pitching apparatus which will enable the average "little leaguer" to practice in his own back yard, unassisted by anyone else. Furthermore, hitting a loose ball about the neighborhood is to be discouraged because of the possibility of incurring property damage. Therefore it is desirable to provide a baseball-pitching device which obviates this undesirable possibility.

SUMMARY OF THE INVENTION

This invention comprehends a ball-pitching apparatus by which a batter can cause a baseball to be pitched along a predetermined trajectory. The apparatus includes a base, an arm pivotally secured to the base, a baseball-receiving container affixed to one end of the arm, and a pair of springs attached in a particular manner for causing the arm to move the container in such a manner that the ball is accelerated along a predetermined trajectory.

The springs include a pitching spring and an arresting spring. The pitching spring has one end affixed to the arm at a location between the pivot point and the container. The arresting spring is affixed to the arm below the pivot point and opposite the container end of the arm. The remaining end of both springs is anchored to the base.

In the more specific embodiment of the invention, a cocking and releasing mechanism enables the batter to remotely control the action of the ball-pitching apparatus.

Accordingly, a primary object of the present invention is the provision of a ball-pitching apparatus which accelerates a ball-containing chamber along a curved path for a first length of travel and thereafter decelerates the container along a second length of travel to cause the ball and container to separate and the ball to continue to travel along a trajectory.

Another object of the invention is to provide apparatus by which a ball is accelerated along an arcuate path so that the ball attains a sufficient velocity to assume a predetermined trajectory respective to the surface of the earth.

A further object of this invention is to disclose and provide a remote controlled ball-pitching apparatus which accelerates a ball-receiving container along a circumference to impart sufficient angular velocity thereinto to cause the ball to continue to travel along a trajectory upon the container being decelerated.

A still further object of this invention is to provide a ball-pitching apparatus for causing a baseball to be accelerated into a trajectory which follows a path of travel similar to a ball being "pitched".

The above objects are attained in accordance with the present invention by the provision of apparatus fabricated in a manner substantially as described in the above abstract and summary.

These and various other objects and advantages of the invention will become readily apparent to those skilled in the art upon reading the following detailed description and claims and by referring to the accompanying drawings.

DETAILED DESCRIPTION OF THE PREFERRED EMBODIMENTS

Figure 1:
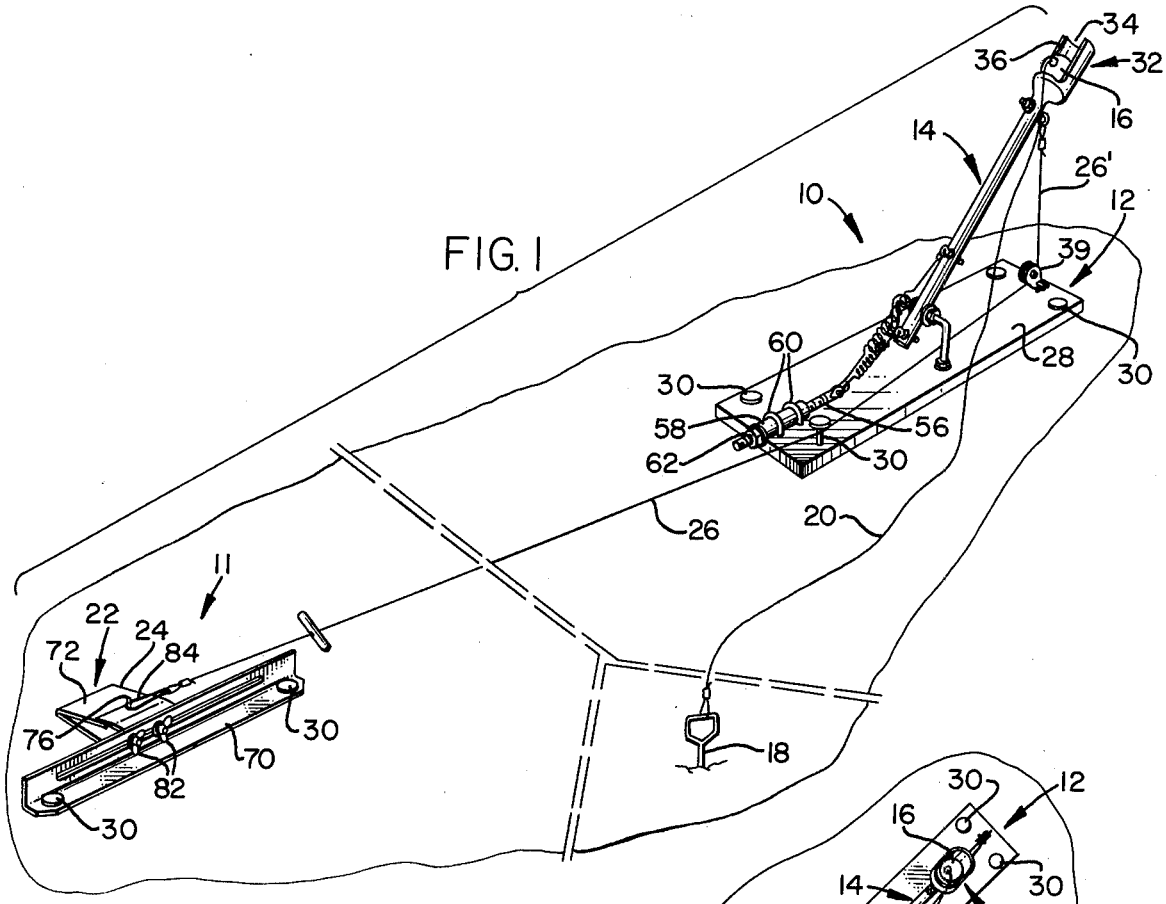
FIG. 1 is an isolated perspective view of a ball-pitching apparatus made in accordance with the present invention.
Figure 2:
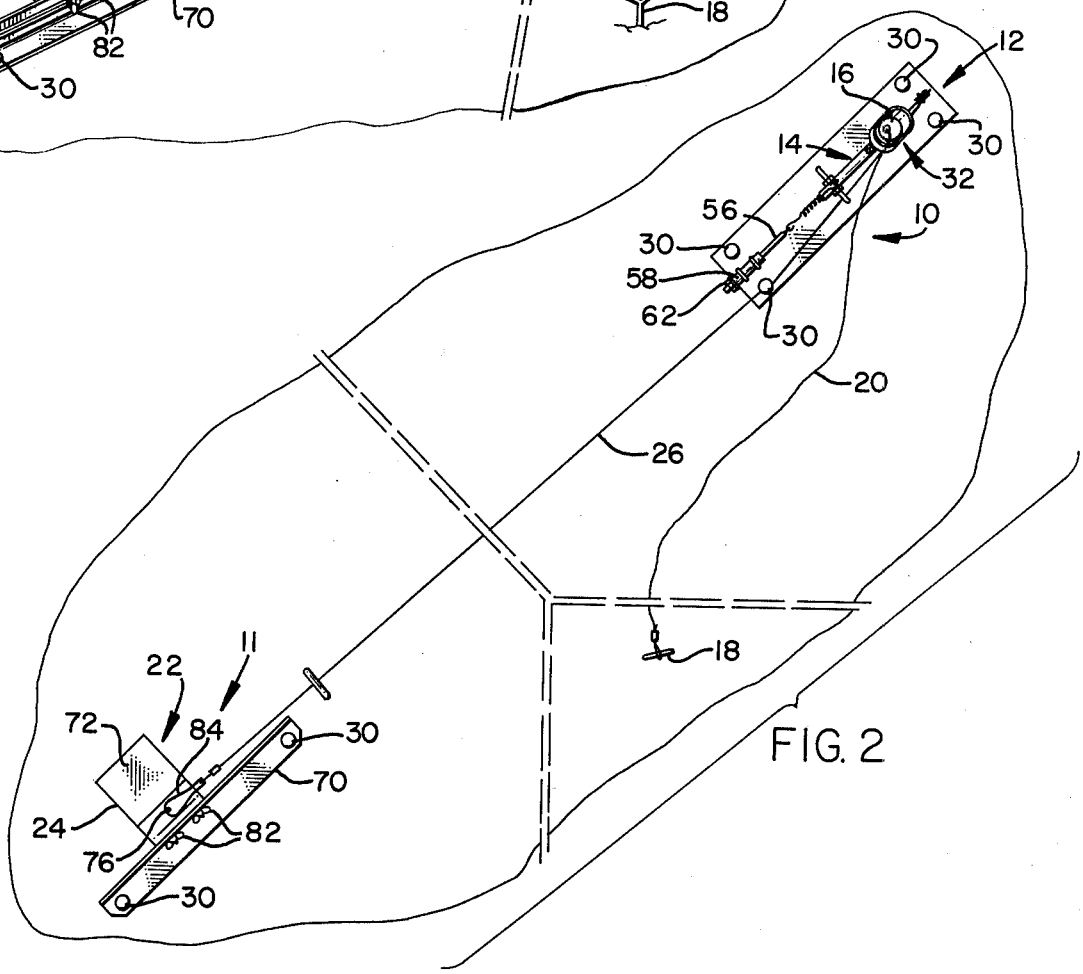
FIG. 2 is an isolated top plan view of the apparatus disclosed in FIG. 1.

The figures of the drawings disclose a ball-pitching apparatus 10 made in accordance with the present invention, which pitches a ball toward a batter standing at 11. The apparatus includes a base 12 which forms a mount means to which there is pivotally mounted a throwing arm 14. The throwing arm has a ball-receiving container at the upper free terminal end thereof for holding a baseball 16 in captured relationship therewithin. Anchor 18 is tied to the ball by a light weight cord or line 20.

A foot-operated trigger device 22 includes a pedal 24 arranged so that when the pedal is depressed, line 26 is released therefrom and the pitching arm is released, whereupon the ball is pitched toward the batter.

Figure 3:
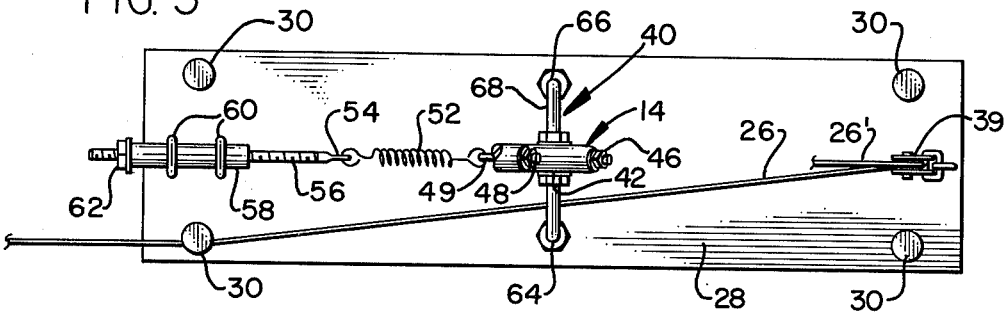
FIG. 3 is an enlarged top plan view of part of the apparatus disclosed in the foregoing figures.
Figure 4:
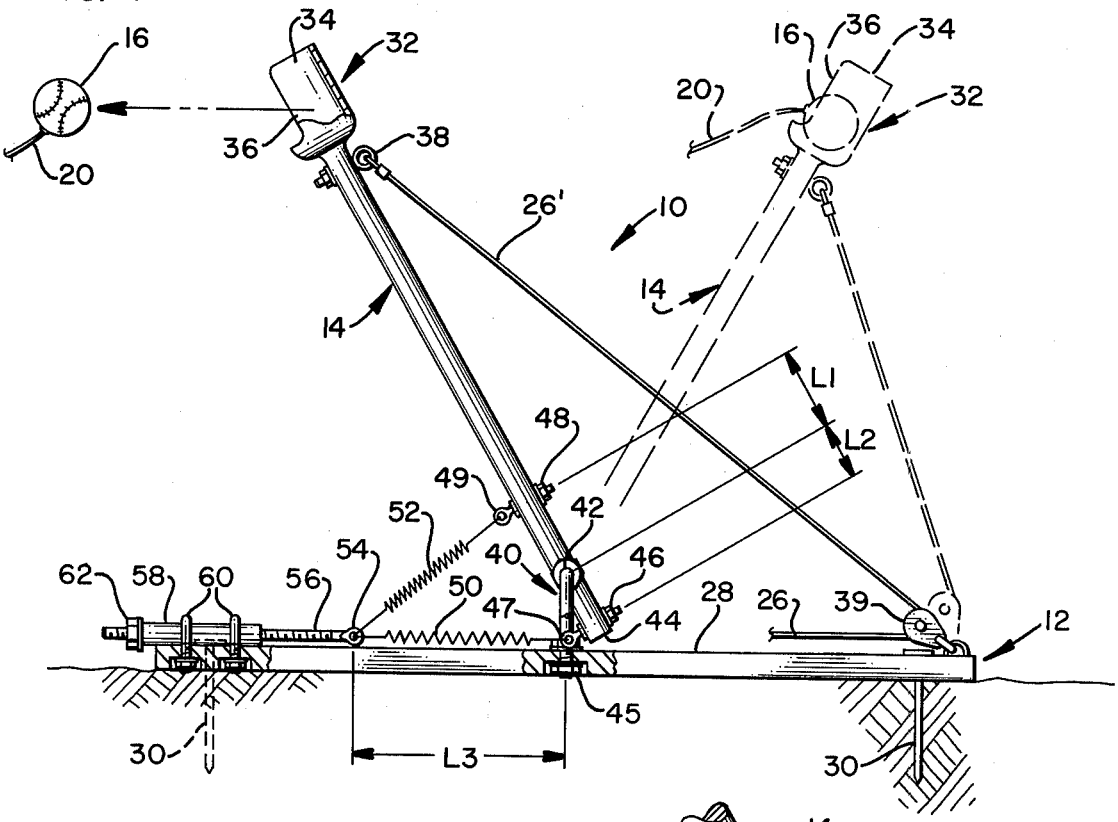
FIG. 4 is a side elevational view of the apparatus disclosed in FIG. 3.
Figure 5:
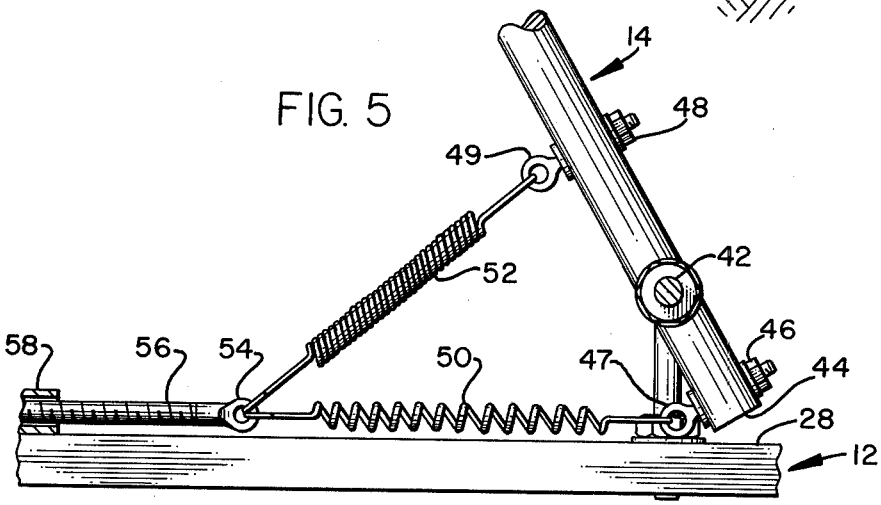
FIG. 5 is an enlarged, fragmentary, detailed view which discloses part of the essence of the present invention.
Figure 6:
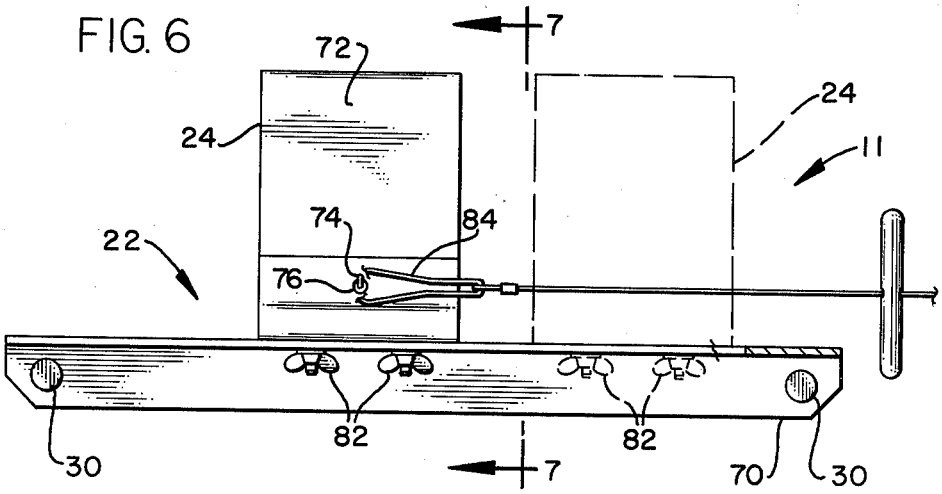
FIG. 6 is an enlarged detail of part of the apparatus disclosed in FIG. 2; and, FIG. 7 is a cross-sectional view taken along line 7—7 of FIG. 6.
Figure 7:
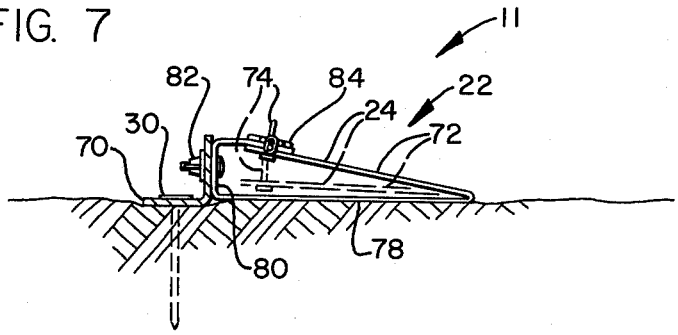

As best seen illustrated in FIGS. 3–5, the apparatus of the present invention includes the before-mentioned base 12 which preferably is staked or pinned to the ground by means of a plurality of spaced pins 30. The pins prevent inadvertent relative movement between the base and the supporting surface of the ground.

The pitching arm includes a ball-receiving container 32 which is upwardly opening at 34 and outwardly opening at 36 so that a ball can be loosely received in captured or supported relationship therewithin. Eyelet 38 secures one end of line 26' thereto so that the line can be brought about pulley device 39 and extended back toward the batter.

An inverted u-shaped bolt 40 is mounted to the base and pivotally secured in a journaled manner to a medial portion of the pitching arm at 42 in such a manner that lower pivotal end 44 of the arm swings in an arcuate manner in close proximity to the upper surface 28 of the platform. The u-shaped bolt is affixed to the platform by any suitable fastening means 45.

Fastener means 46 provides an eyelet 47 which underlies pivot point 42, while fastener 48 has an eyelet 49 formed thereon and is spaced above pivot point 42 and below the container 32. Steel springs 50 and 52 respectively, have one end portion thereof attached to the eyelets at 47 and 49, respectively, with the remaining end portions being attached to one another at the aperture 54. The aperture 54 is formed in one end of a threaded shaft 56.

Shaft 56 is slidable axially within an anchored sleeve 58. The sleeve is attached to the platform by means of spaced u-bolts 60. A nut 62 threadedly engages the opposed threaded end of shaft 56 so that the aperture 54 can be moved toward or away from the u-bolt 40.

The before-mentioned inverted u-shaped bolt is provided with opposed legs 64 and 66 which are joined together by a horizontal midportion 68. The pitching arm is drilled laterally and provided with a suitable journal means by which it can be pivotally supported in long-lasting and low friction relationship in the illustrated manner of FIGS. 4 and 5.

The release mechanism 22 is preferably in the form of an angle iron 70 to which release pedal 24 is adjustably mounted. The pedal is in the form of a bent-up piece of resilient steel having a foot-engaging surface 72 by which a pin 74 can be forced in a downward direction, whereupon the pin in withdrawn from an aperture 76. The pedal has a lower ground-engaging surface 78 and a vertical wall 80. Fastener means 82, in the form of spaced bolts and wing nuts, releasably attach the pedal to the member 22. An elongated slot enables the pedal to be moved toward or away from the platform 12, thereby adjusting the length of the line 26.

The pitching arm together with the ball-receiving container preferably measures 36 inches in overall length. As indicating in FIG. 4, L1 is $6\frac{1}{2}$ inches, L2 is $2\frac{1}{4}$ inches, and the journal 42 is placed 4 inches above the platform surface 28, while the eyelet 54 is placed 11 inches from the legs 64 and 66. The distance from 49 to 54 is 12 inches while the distance from 47 to 54 is 11 inches. The measurements indicate one form of the invention which has been satisfactorily reduced to practice, and which were observed with the apparatus being placed in the neutral or "uncocked" configuration.

The effective length of spring 52 is $6\frac{1}{2}$ inches while the effective length of spring 50 is 9 inches. Spring 52 is $\frac{3}{4}$ inch outside diameter with the outside diameter of the steel being slightly less than $\frac{1}{8}$ inch in diameter. The spring includes approximately 17 turns for each two inches of its length. The spring 50 is identical to spring 52 except for the effective length thereof.

When the apparatus is uncocked, that is, in its dormant configuration, the spring 50 is under slightly more tension as compared with spring 52, with the convolutions of spring 50 being slightly spaced apart from one another while the convolutions of spring 52 are essentially adjacent to one another, or in an apparent un sprung configuration, although both springs are under a measurable amount of tension.

In operation, the platform 12 is pegged into the ground by driving pins 30 through the apertures formed in the marginal edge portion of the platform, and into the surface of the field of play. The release mechanism 22 is spaced from the platform approximately 23 feet, so that when the apparatus is cocked, a metal loop 84 attached to the end of line 26 can be placed over pin 74, thereby maintaining the arm in the cocked position. Energy has been stored in spring 50 at this time.

The ball 16 is next placed within the upwardly opening, ball receiving container and line 20 connected to the stake 18 which preferably is driven into the ground at an offset position so as to maintain a clear line between the batter and the ball pitching device of the present invention.

As the batter pulls the line 26 towards the batter position, the pitching arm is rotated into its alternate dot-dash position illustrated in FIG. 4, thereby releasing the tension within the arresting spring while increasing the tension within the pitching spring. The batter faces the pitching apparatus and places his foot upon platform 24. When the platform is depressed by the batter's foot, pin 74 is withdrawn from aperture 76 so that the ring 84 is released therefrom, thereby slackening line 26 and releasing the pitching arm. This action causes the arm to travel from its cocked into its uncocked configuration with sufficient force to cause the ball 16 to travel towards and arrive at the batter at a proper height. The batter strikes the ball and line 20 permits easy retrieval thereof.

If additional pitching force is desired by the batter, platform 24 is moved away from the platform 12. Still additional pitching force and a different trajectory can be obtained if desired, by screwing the nut 62, thereby moving eyelet 54 further away from eyelets 47 and 49.

It will be appreciated, having studied the above disclosure, that rotation of the pitching arm into the alternate or cocked configuration reduces spring tension 50 to a minimum while substantially increasing or storing energy into spring 52. When the apparatus pitches the ball, the arm travels toward the pitcher until it is arrested by spring 50, with the resilient arresting force being provided over a substantial distance of travel as the arm reaches the position of FIG. 4. Moreover, the employment of two spring forces in the manner of FIGS. 4 and 5 prevents undue oscillation of the arm 14 as it reaches the end of its pitching stroke.

The essence of the present invention is in the provision of a pitching arm having one end thereof formed into a ball receiving container with the remaining marginal end thereof being journaled to a support means to thereby provide three moment arms. The first moment arm is measured from the journal means to the pivoted or ball pitching end, the second moment arm is located between the journal and the ball container, while the third moment arm is located in opposition to the first and second moment arms. The spring force is placed at the ends of the second and third moment arms. In the illustrated example, the spring forces are tied together at 54 so that a single adjustment means can change the forces involved.

As an alternate embodiment of the present invention, the spring ends at 54 may be individually attached to the support means 28, thereby enabling the two opposed forces to be adjusted with respect to one another rather than concurrently as in the illustrated manner of FIGS. 4 or 5. Moreover, the eyelet 49 can be placed at a plurality of different locations between the journal means 42 and the ball container 32 to thereby achieve different trajectories of the ball.

Where deemed desirable, the trigger mechanism can be complicated by the provision of a releasable stop means which releasably engages the end 44 of the arm so that the releasable latch means is automatically engaged as the line 26 is pulled, and thereafter released by a suitable foot actuated means.

In one reduction to practice, the ball-receiving container 32 was made from a plastic carton by cutting the ends and sides in the illustrated manner of FIG. 4. This geometrical configuration loosely supported a baseball 16 as indicated by the dot-dash lines of FIG. 4. The plastic carton was affixed to the end of a PVC water pipe which measured 1¼ inches outside diameter. The plastic pipe and the neck of the carton were telescoped together and glued. The support means 40 was an all-thread bolt which was heated and bent into the illustrated U-shaped configuration. This expedient enabled spaced nuts to be used in anchoring the U-bolt to the platform and further provided a means by which the arm could be captured to the medial portion of the U-bolt. The platform 28 was a standard long piece of 2 × 12 inches lumber. In this particular embodiment of the invention, a five-pound force was exerted at 34 in order to move the pitching arm to the vertical position. Additional forces are required to move the pitching arm into the cocked configuration. The amount of force required to fully cock the apparatus depends upon the length of the line 26 respective to the distance measured to apparatus 11.

The present invention enables young people to practice batting a ball without the assistance of any other person. The apparatus is simple in construction and operation, and is perfectly suitable for ball players between the ages of 8 and 80 years old. The apparatus can be placed in a relatively small yard where hours of meaningful and enjoyable practice can be achieved, without the threat of damage to the surroundings.

I claim:

1. Ball pitching apparatus comprising a base, means for releasably supporting a baseball, an arm having opposed ends, a pitching spring, and an arresting spring;

a journal formed on a medial portion of said arm in spaced relation to said opposed ends thereof to thereby present an upper marginal end and a lower marginal end; mount means by which said journal is supported at an elevation above said base to thereby permit said arm to be pivotally mounted in spaced relationship respective to said base such that each of the opposed marginal ends pivot about a common pivot point;

said means for releasably supporting a baseball being affixed to said upper marginal end of said arm; said arresting spring having opposed ends with one end thereof being directly connected to said lower marginal end portion of said arm;

said pitching spring having opposed ends with one end thereof being connected to upper marginal end of said arm at a location between said mount means and said means for releasably supporting a baseball; the other end of said pitching and arresting springs extend away from said arm, towards one another, and towards a common end of said base;

pitching spring and arresting spring tension adjustable fastener means having one common anchor point to which said other ends of said pitching and arresting springs are anchored to said common end of said base;

said springs jointly cooperating with said adjustable fastener means to normally bias said arm into a position of rest with the arm being positioned forwardly of a rearward position, whereupon said arm can be forced into a rearward position to store energy in said pitching spring, and when said arm is released said pitching spring accelerates said means for releasably supporting a baseball in a forward direction, while said arresting spring arrests said arm before said means for releasably supporting a baseball approaches the end of its travel, with the arresting force being progressively applied to decelerate the arm until the arm reverses its path of travel and returns to said position of rest.

2. The apparatus of claim 1 and further including a latch means by which said arm can be latched into the rearward position, and further including trigger means by which said latch means can be released to thereby allow said arm to pivot in the forward direction.

3. The apparatus of claim 1 wherein said means for releasably supporting a baseball comprises an upwardly and outwardly opening container having a concave bottom portion within which a ball is gravitated into a position of rest;

so that when said container is accelerated, the angular velocity of a ball contained within said container will cause a ball to be separated from the container when said container is decelerated by said arresting spring, so that a ball leaves the container with a horizontal component of velocity that carries a ball to a batter standing spaced therefrom, whereupon the batter can attempt to hit a ball with a bat.

4. Ball pitching apparatus comprising an arm having opposed upper and lower marginal ends, a base having a forward and a rear end, a ball holder affixed to the upper terminal end of said arm within which a baseball can be releasably supported;

a journal formed at a medial portion of said arm, a mount means upwardly extending above said base by which said journal is pivotally affixed to said base such that said opposed upper and lower marginal ends of said arm may be pivoted toward and away from said forward end and said rear end of said base; pitching spring and arresting spring tension adjustable fastener means located on said forward end of said base; said adjustable fastener means having a longitudinally adjustable shank portion; pitching biasing means having opposed ends with one end thereof being connected directly to said arm at a location between said mount means and said ball holder and the other end thereof being connected to said shank of said adjustable fastener means so that said ball holder is biased toward said forward end of said base;

arresting biasing means spaced from said pitching biasing means, said arresting biasing means having opposed ends with one end thereof being connected directly to said lower marginal end of said arm at a location which is opposed to said ball holder and the other end thereof being connected to said shank of said adjustable fastener means so that said ball holder is biased toward said rear end of said base;

whereby; said arm can be pivoted to move said ball holder toward said rear end of said base while storing energy within said pitching biasing means, whereupon said arm can be released to thereby angularly accelerate said ball holder and a ball contained therewithin, and thereafter said arresting biasing means arrests said ball holder sufficiently to cause the ball to continue to travel in a horizontally direction away from said ball holder.

5. The apparatus of claim 4 wherein means are provided for cocking said arm and subsequently remotely triggering said arm so that a batter can stand spaced from said forward end of said base and trigger said arm to release stored energy in said pitching spring, thereby permitting a batter to cause a ball to be pitched toward him by manipulating the triggering device.

6. The apparatus of claim 4 and further including a latch means by which said arm can be latched into the rearward position, and further including trigger means by which said latch means can be released to thereby allow said arm to pivot in the forward direction.

* * * * *